US009874342B1

(12) United States Patent
Liu et al.

(10) Patent No.: US 9,874,342 B1
(45) Date of Patent: Jan. 23, 2018

(54) GAS WARNING HEAD LAMP

(71) Applicant: Ningbo Kingdun Electronic Industry Co., Ltd, Yuyao (CN)

(72) Inventors: Xueyong Liu, Yuyao (CN); Fulong Zhu, Yuyao (CN)

(73) Assignee: Ningbo Kingdun Electronic Industry Co., Ltd., Yuyao (CN)

( * ) Notice: Subject to any disclaimer, the term of this patent is extended or adjusted under 35 U.S.C. 154(b) by 0 days.

(21) Appl. No.: 15/663,840

(22) Filed: Jul. 31, 2017

(30) Foreign Application Priority Data

Feb. 13, 2017 (CN) ..... 2017 1 0004742

(51) Int. Cl.

| | |
|---|---|
| ***G08B 21/14*** | (2006.01) |
| ***G08B 17/117*** | (2006.01) |
| ***G08B 21/12*** | (2006.01) |
| ***G08B 21/16*** | (2006.01) |
| ***F21V 21/084*** | (2006.01) |
| ***F21L 14/00*** | (2006.01) |
| ***F21V 25/12*** | (2006.01) |
| ***F21V 33/00*** | (2006.01) |
| ***F21V 23/00*** | (2015.01) |
| ***F21L 4/08*** | (2006.01) |

(Continued)

(52) U.S. Cl.

CPC ..... *F21V 25/12* (2013.01); *A42B 3/044* (2013.01); *A42B 3/046* (2013.01); *A42B 3/0453* (2013.01); *F21L 4/08* (2013.01); *F21V 21/0885* (2013.01); *F21V 21/145* (2013.01); *F21V 23/008* (2013.01); *F21V 31/005* (2013.01); *F21V 33/0076* (2013.01); *G08B 21/12* (2013.01); *F21V 7/00* (2013.01); *F21V 23/001* (2013.01); *F21V 23/04* (2013.01); *F21Y 2115/10* (2016.08)

(58) Field of Classification Search

CPC ..... F21V 15/12

See application file for complete search history.

(56) References Cited

U.S. PATENT DOCUMENTS

| | | | | |
|---|---|---|---|---|
| 4,199,802 A * | 4/1980 | Malm | ..... | A42B 3/044 362/105 |
| 2003/0067769 A1* | 4/2003 | Gilpin | ..... | F21L 4/027 362/184 |

(Continued)

FOREIGN PATENT DOCUMENTS

CN 105042545 A 11/2015

*Primary Examiner* — Joseph Feild
*Assistant Examiner* — Pameshanand Mahase
(74) *Attorney, Agent, or Firm* — Gokalp Bayramoglu

(57) ABSTRACT

The present invention discloses a gas warning head lamp, including a helmet and a head lamp, wherein the head lamp includes a lamp holder assembly, a power control compartment and a sheathed wire. The helmet is provided with a snapping seat, and the lamp holder assembly is snapped into the snapping seat on the helmet. The power control compartment includes an upper cover of the compartment, a main power supply housing, a battery pack and a control panel; wherein the upper cover and the main power supply housing are assembled together in a sealed explosion-proof configuration to form a housing of the power control compartment. The battery pack and the control panel are electrically connected to each other by a built-in line. An end of the sheathed wire is electrically connected to the control panel, and the other end of the sheathed wire is connected to the lamp holder assembly.

10 Claims, 8 Drawing Sheets

(51) Int. Cl.

| | |
|---|---|
| ***F21V 21/14*** | (2006.01) |
| ***F21V 31/00*** | (2006.01) |
| ***F21V 21/088*** | (2006.01) |
| ***A42B 3/04*** | (2006.01) |
| *F21Y 115/10* | (2016.01) |
| *F21V 23/04* | (2006.01) |
| *F21V 7/00* | (2006.01) |

(56) References Cited

U.S. PATENT DOCUMENTS

2011/0105851 A1* 5/2011 Horvath ..... A61B 50/26
600/249
2012/0120635 A1* 5/2012 Strong ..... F21V 21/084
362/105

* cited by examiner

GAS WARNING HEAD LAMP

CROSS REFERENCE TO RELATED APPLICATIONS

This application is based upon and claims priority to Chinese Patent Application No. CN201710004742.5, filed on Feb. 13, 2017, the entire contents of which are incorporated herein by reference.

TECHNICAL FIELD

The present invention relates to the field of a cap lamp for mining, and more particularly to a cap lamps capable of automatically raising an alarm when the gas concentration exceeds the safety limit. In particular, it's a gas warning head lamp.

BACKGROUND OF THE INVENTION

Gas is one of the main coal mining disaster factors in China. Disasters such as the explosion of coal dust, coal and gas outburst, etc. seriously threaten the safety of coal mines in China. Because of the variety of disaster factors and great governance difficulties, mine gas has always been a top priority and difficulty for the security administrative work of the coal mines in China. At present, the current situation of coal mine safety in China is that: coal mine gas explodes, coal and gas outburst becomes more and more serious and the risk is thus increased. The coal mines in China are all fiery mines, gas disaster has become a main constraint on the safety of coal production and coal industry development. According to national coal mine accident statistics in 2015, there were 71 large and medium-sized mine accidents, wherein 21 accidents were related to gas, accounting for 29.6% of the total mine accidents. The number of casualties in gas accidents accounted for 42.5% of the total casualties. At present, the gas alarms used in coal mines are stand-alone gas alarms, because of the huge sizes of the gas alarms, they are sparsely installed, thus they cannot monitor all the areas effectively.

A solution which combines the gas alarm and the head lamp cap is disclosed in the prior art. For example, a Chinese patent application with the application number of CN 105042545 A, discloses a head lamp cap comprising a head lamp cap body and a head lamp. The head lamp comprises a lamp holder and a lamp body connected to the lamp holder. And the head lamp is fixed on the top surface of the head lamp cap body, wherein the head lamp body is provided with a methane alarm device. Although this design structure can make every user of the head lamp a gas concentration monitor, because the head lamp is fixed on the top surface of the head lamp cap body, it potentially increases the weight of the cap. Furthermore, with the head lamp provided on the top surface of the head lamp cap body, the head lamp body it will be hit first when a heavy object falls. And the hit will cause the failure or sparks of the circuit inside the head lamp body, which will in turn lead to a risk of explosion when the gas concentration reached the explosion point.

SUMMARY OF THE INVENTION

The technical problem to be solved by the present invention is to provide a gas warning head lamp in view of the above-mentioned state of the prior art, the gas warning head lamp of the present invention is well-designed, highly safe, comfortable and easy to wear, and capable of monitoring the gas concentration in real time. Further, the helmet and the head lamp are separate.

To solve the technical problem, the technical solution adopted by the present invention is provided as follows: A gas warning head lamp, comprising a helmet and a head lamp, configured to be worn separately, wherein the head lamp comprises a lamp holder assembly, a power control compartment and a sheathed wire. Wherein a front face of the helmet is provided with a snapping seat, and the lamp holder assembly is snapped into the snapping seat on the helmet. The power control compartment comprises an upper cover of the compartment, a main power supply housing, a battery pack and a control panel. Wherein the upper cover and the main power supply housing are assembled together in a sealed explosion-proof configuration to form a housing of the power control compartment. The battery pack and the control panel are provided inside the compartment and electrically connected to each other by a built-in line. An end of the sheathed wire hermetically goes though the upper cover and is electrically connected to the control panel with a sealing effect of no liquid penetration, and an other end of the sheathed wire is hermetically connected to the lamp holder assembly by the waterproof liquid. A gas sensor for gas concentration detection in a current working area is integrated in the lamp holder assembly. The control panel at least comprises a main control module for driving the lamp holder assembly to raise an alarm by a blinking light through an electric signal when the gas concentration provided by the gas sensor reaches a minimum value, and an alarm module is simultaneously driven by the main control panel through the electric signal to sound an alarm with a beeping signal. The power control compartment is provided with a charging seat for charging the battery pack, wherein the charging seat is connected to a power plug engaged with an external power supply. A wire clip is provided at the back part of the helmet, the sheathed wire is snapped into the wire clip, and the wire clip is located at 180 degrees from the snapping seat.

To optimize the technical solution, the measures taken further comprises:

The lamp holder assembly comprises a lamp housing, a transparent lamp cover provided inside the lamp housing, a reflector, an LED light source and a signal acquisition panel, wherein the reflector is provided inside the transparent lamp cover, and the LED light source is provided behind the reflector, wherein the LED light source is connected to the signal acquisition panel through a switch button, and a button installing window is provided on an upper part of the lamp housing, wherein the button installing window is provided with a sealing washer with an explosion-proof function and a button cover, a detection window for installing the gas sensor is provided on a lower part of the lamp housing, the gas sensor is hermetically provided inside the detection window through a sealing ring with the explosion-proof function.

The lamp housing comprises a lamp socket, an explosion-proof sheath and a lamp cover, and the lamp socket, the explosion-proof sheath and the lamp cover are assembled from rear to front successively. Wherein the detection window and the button installing window are both formed on the explosion-proof sheath. A front side of the lamp cover is provided with transparent explosion-proof glass. The gas sensor is connected to the signal acquisition panel, and the sheathed wire hermetically goes though the lamp socket and is connected to the signal acquisition panel with a sealing effect of no liquid penetration.

A rear end of the lamp socket is provided with a light snapping element, and the light snapping element is engaged with a snapping seat. Wherein the light snapping element is attached to the rear end of the lamp socket with a hinge around a rotation shaft, both sides of the light snapping element are respectively provided with a snapping groove, which is engaged with a snapping strip of the snapping seat. The lamp holder and the upper cover are respectively provided with a waterproof joint through which the sheathed wire hermetically goes with a sealing effect of no liquid penetration.

The lamp holder assembly is detachably mounted onto the helmet through the light snapping element, and the lamp holder assembly is capable of rotating up and down relative to the light snapping element around the rotation shaft. Wherein a minimum angle range of the up and down rotation of the lamp holder assembly is 45 degrees, while a maximum angle range of the up and down rotation of the lamp holder assembly is 90 degrees.

An explosion-proof mat is pressed and provided between the lamp holder and the explosion-proof sheath, the detection window extends obliquely frontward and downward from the bottom of the explosion-proof sheath.

The LED light source comprises a high-power LED for illumination and a red warning alarm light for raising an alarm by flashing the light. The upper part of a back side of the lamp holder is formed with a wiring window extending obliquely backward and upward, the waterproof joint of the lamp holder is provided on the wiring window, and the sheathed wire hermetically goes through the wiring window of the lamp socket by the waterproof liquid, and is connected to the signal acquisition panel.

The control panel is longitudinally fixed inside the compartment, and a lower end of the control panel is provided with a metal charging pin. A bottom of the main power supply housing of the compartment is formed with a concave surface, and the metal charging pin slightly extend downward out of the concave surface, wherein the charging seat is provided with a charging elastic piece, elastically contacting with the metal charging pin to charge the electrically connected battery pack, and the charging elastic piece is connected to the power plug.

The top of the charging seat is formed of a charging recess. Wherein a lower part of the main power supply housing is configured to be inserted in the charging recess. The charging elastic piece is a rectangular metal piece made of copper, an end of the metal piece is fixed in an installing chamber of the charging seat, and an other end of the metal piece is a free end. Wherein a contact portion of the metal piece elastically projects into the charging recess through the installing chamber, and the contact portion of the metal piece elastically contacts with the metal charging pin.

The upper cover is formed with a connection window, the waterproof joint on the upper cover is provided in the connection window, and the sheathed wire extends into the compartment through the connection window and is electrically connected to the control panel.

Compared with the prior art, the helmet and the head lamp in the present invention can be detached from each other. The helmet and the head lamp can be worn separately, and thus can be used with more portability and flexibility. The head lamp comprises a lamp holder assembly for illumination, a power control compartment and a sheathed wire. Wherein a gas sensor for gas concentration detection in the current working area is integrated in the lamp holder assembly, which makes every user of the head lamp a gas monitoring point, so as to effectively monitor the gas concentration in real time. The power control compartment comprises an upper cover, a main power supply housing, a battery pack and a control panel, wherein the upper cover and the main power supply housing form a housing of the compartment; and the battery pack and the control panel are provided inside the housing. The control panel is provided with a main control module and an alarm module. The main control module is capable of computing the gas concentration signal value transmitted by the gas sensor and then comparing the value with the reference value stored in the main control module. When the gas concentration is greater than 1%, the electric signal will drive the lamp holder assembly to raise an alarm by red blinking lights, and simultaneously drive the alarm module to sound an alarm with a beeping signal, which can promptly alert every user of the head lamp to quickly evacuate from the current work area. The present invention is well-designed, highly safe, easy to wear and capable of monitoring the gas concentration in real time, which improves the reliability and effectiveness of the monitoring.

Wherein, the reference designators are provided as follows:

Alarm Module B, Waterproof Joint F, Explosion-Proof Mat F1, Switch Button K, Button Installing Window K1, Detection Window K2, Wiring Window K3, Sealing Washer M1, Sealing Ring M2, Button Cover N, Helmet 1, Snapping Seat 11, Wire Clip 12, Lamp Holder Assembly 2, Transparent Lamp Cover 21, Reflector 22, LED Light Source 23, Signal Acquisition Panel 24, Lamp Socket 25, Explosion-Proof Sheath 26, Lamp Cover 27, Sheathed Wire 3, Power Control Compartment 4, Connection Window 4*a*, Upper Cover 41, Main Power Supply Housing 42, Battery Pack 43, Control Panel 44, Metal Charging Pin 45, Gas Sensor 5, Charging Seat 6, Installing chamber 6*a*, Charging recess 6*b*, Power Plug 61, Charging Elastic Piece 62, Light Snapping Element 7, Snapping Groove 71, Rotation Shaft 8

DETAILED DESCRIPTION OF THE INVENTION

The invention will now be described further below with reference to the accompanying drawings and specific embodiments thereof.

Figure 1:
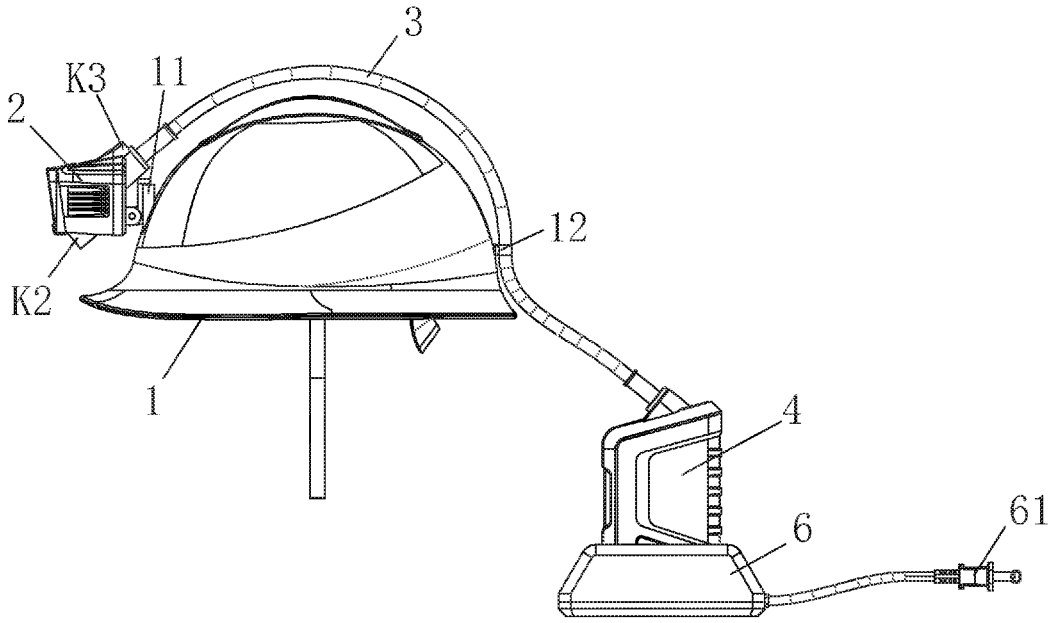
FIG. 1 is a schematic diagram of the present invention.
Figure 2:
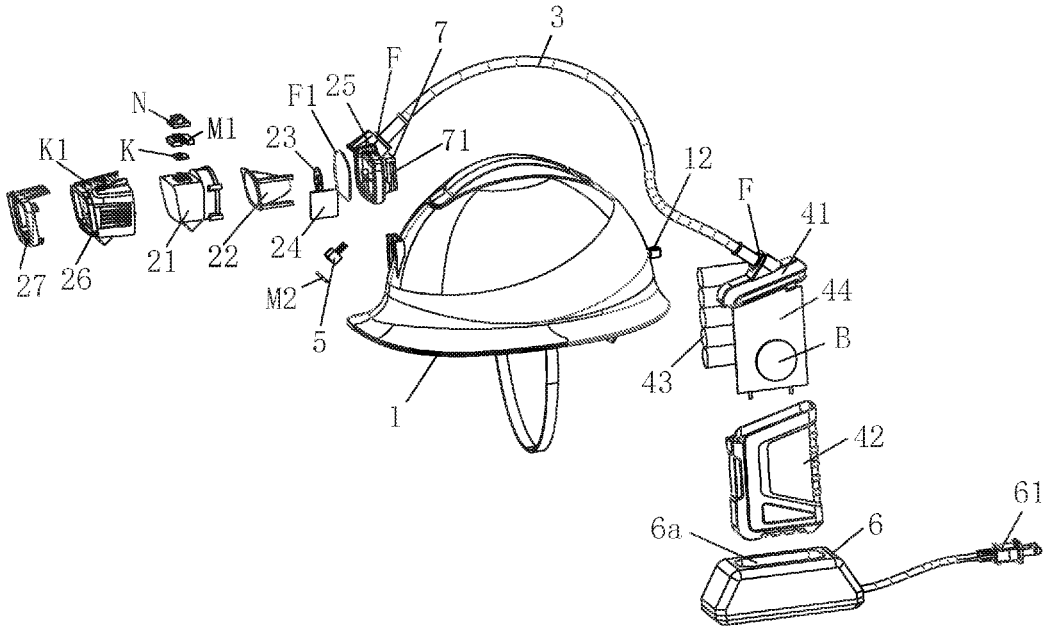
FIG. 2 is a schematic exploded view of the present invention.
Figure 3:
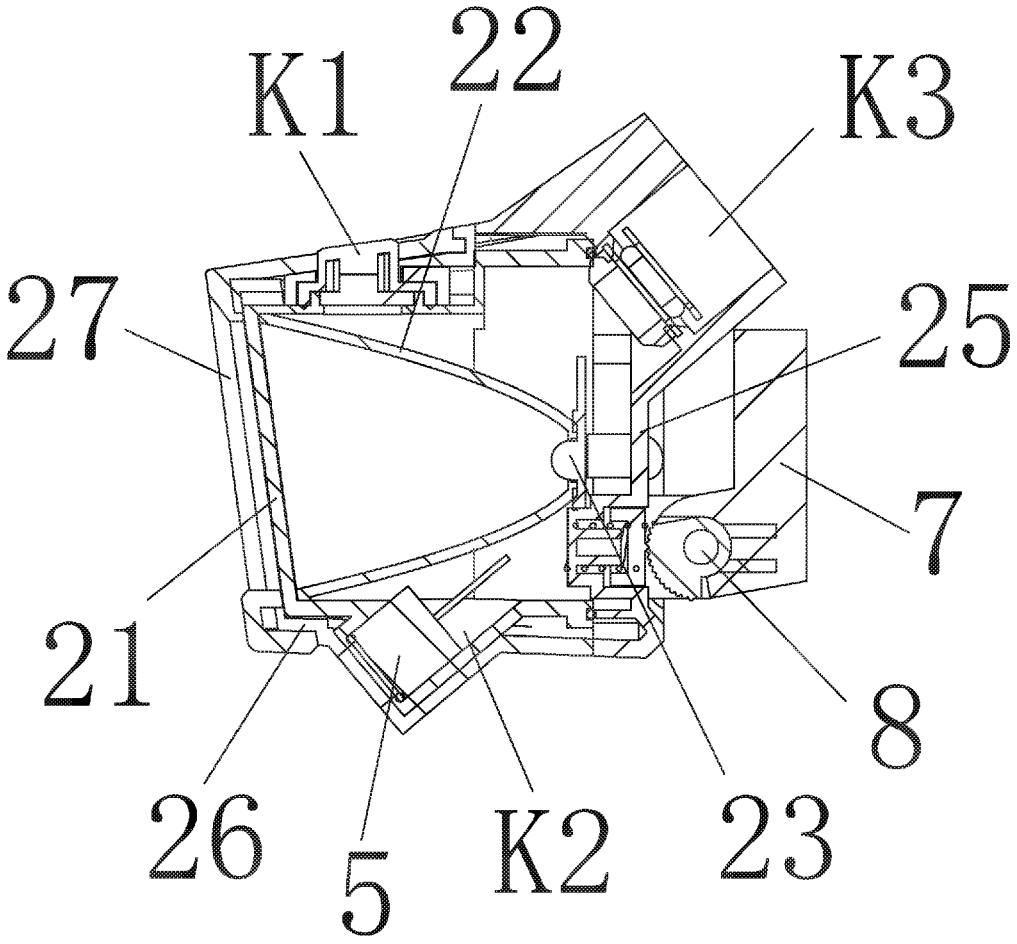
FIG. 3 is a schematic diagram of the lamp holder assembly as shown in FIG. 1.
Figure 4:
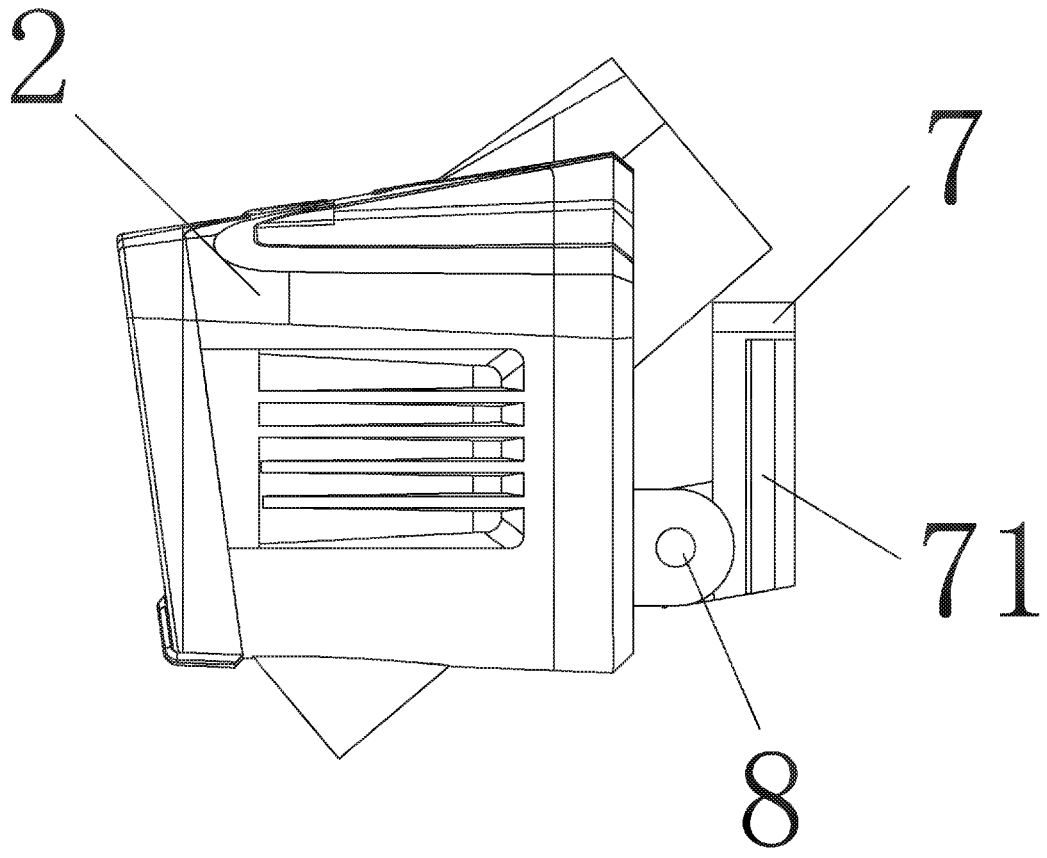
FIG. 4 is a right sight view of FIG. 3.
Figure 5:
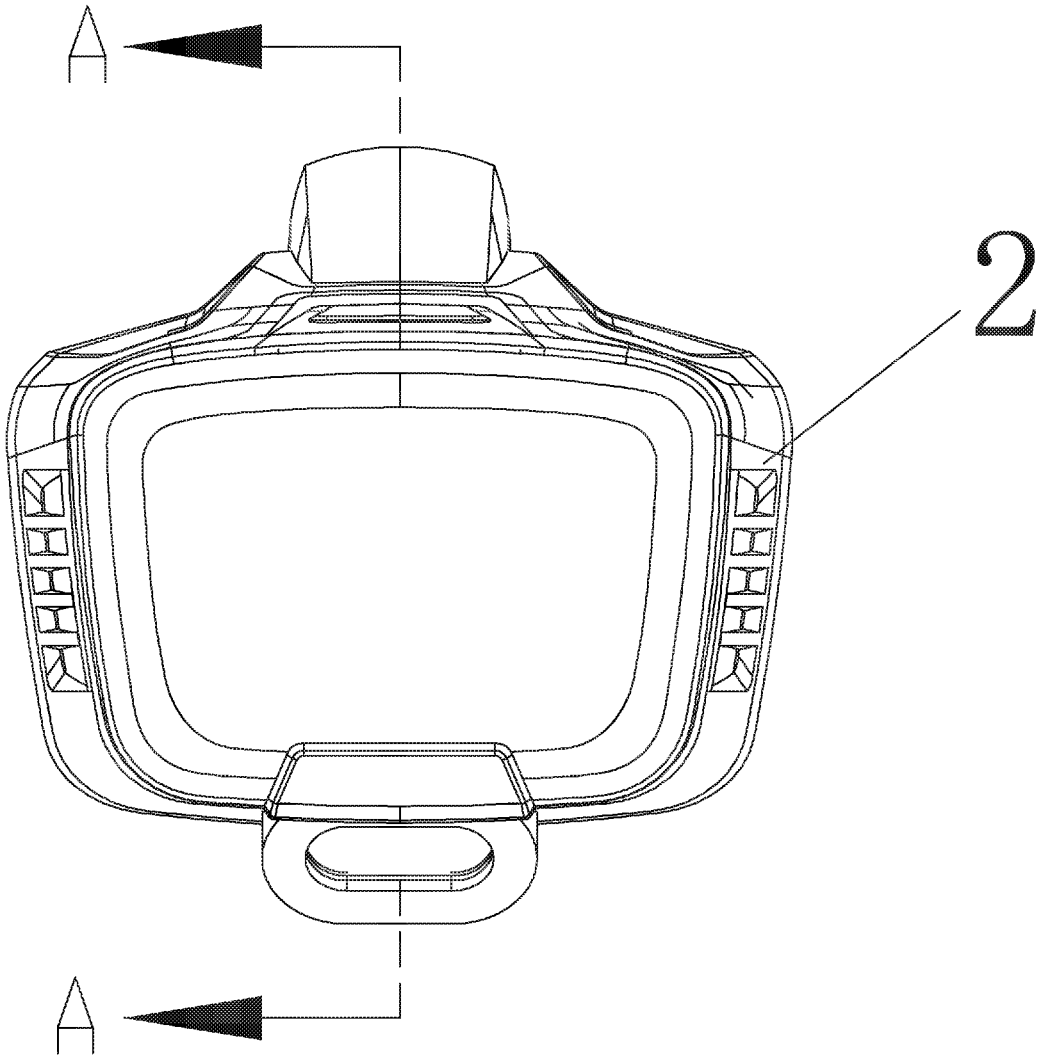
FIG. 5 is a cross-sectional view taken along line A-A of FIG. 4.
Figure 6:
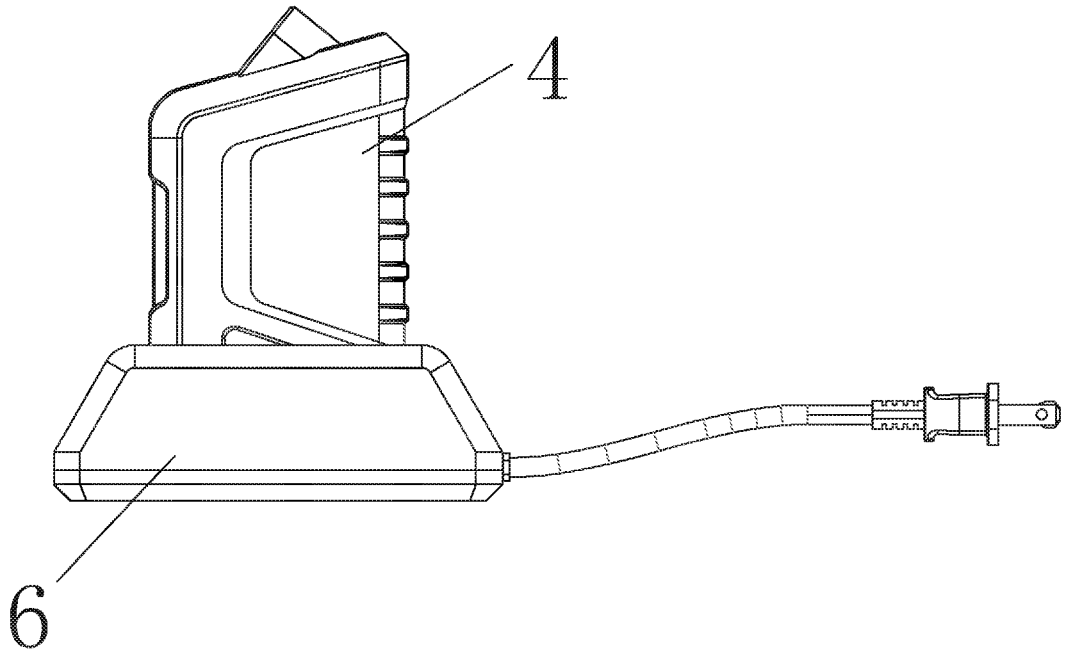
FIG. 6 is a schematic diagram of a state when the power control compartment and the charging seat of the present invention is being charged.
Figure 7:
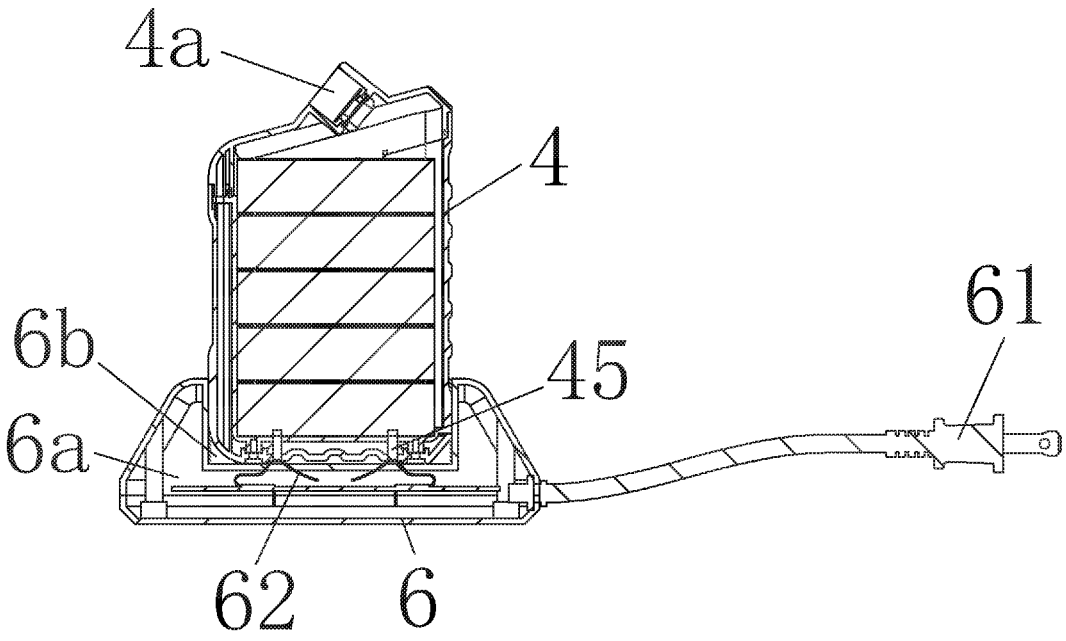
FIG. 7 is a right sight view of FIG. 6.
Figure 8:
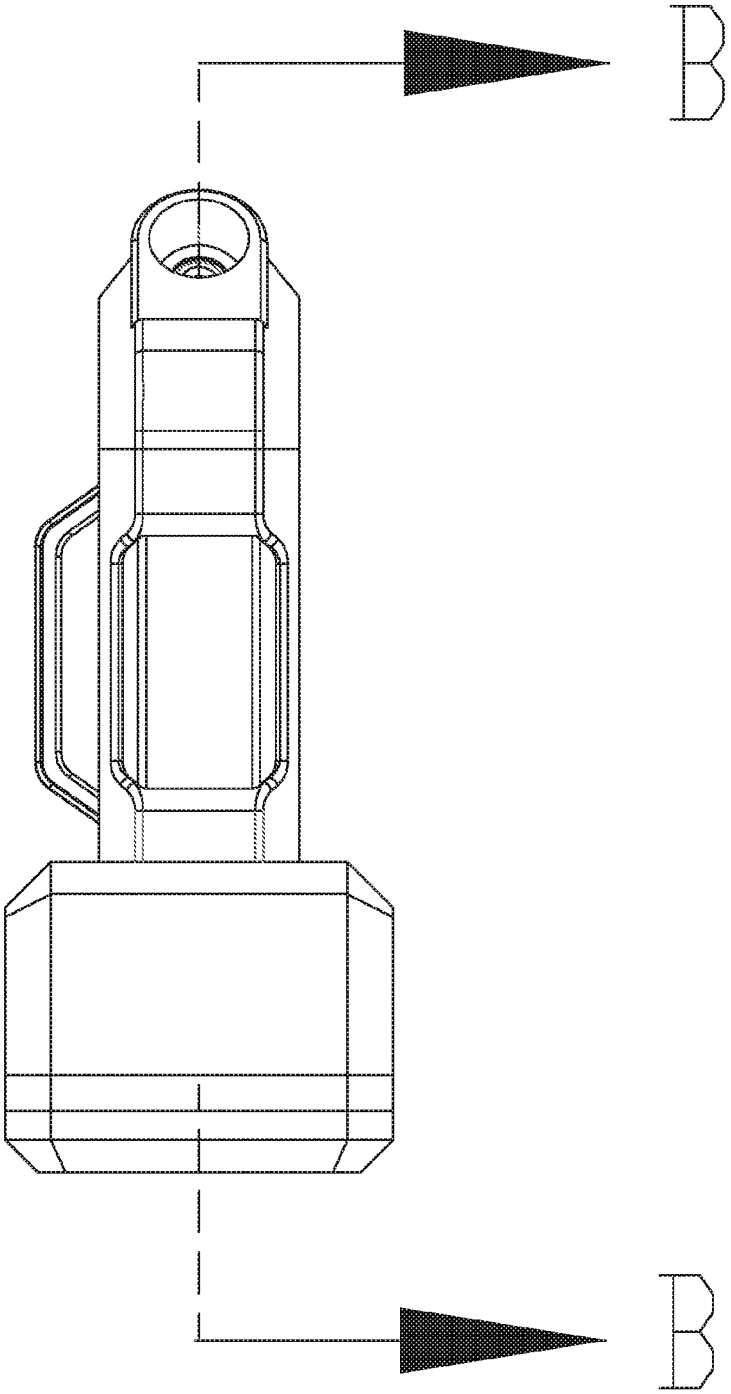
FIG. 8 is a cross-sectional view taken along line B-B of FIG. 7.

FIGS. 1 to 8 are schematic diagrams of the embodiments of the present invention.

As shown in FIGS. 1 to 8, a gas warning head lamp of the present invention, comprises a helmet 1 and a head lamp, and they can be detached from each other and worn separately. Wherein the head lamp comprises a lamp holder assembly 2 for illumination, a power control compartment 4 for power supply, and a sheathed wire 3 connected between the lamp holder assembly 2 and the power control compartment 4 for working as a power supply line. Wherein the front face of the helmet 1 is provided with a snapping seat 11, wherein for the lamp holder assembly 2 is snapped into the snapping seat on the helmet 1. The power control compartment 4 comprises an upper cover 41 of the compartment, a main power supply housing 42, a battery pack 43 and a control panel 44. Wherein upper cover 41 and main power supply housing 42 are assembled together in a sealed explosion-proof configuration to form a housing of the power control compartment and the battery pack and the control panel are provided inside the housing and electrically connected to each other by a built-in line. An end of the sheathed wire 3 hermetically goes though the upper cover 41 and is electrically connected to the control panel 44 with a sealing effect of no liquid penetration. The other end of the sheathed wire 3 is similarly hermetically connected to the lamp holder assembly 2 by the waterproof liquid. A gas sensor 5 for gas concentration detection in the current working area is integrated in the lamp holder assembly 2. The control panel 44 at least comprises a main control module for driving the lamp holder assembly to raise an alarm by blinking lights through an electric signal when the gas concentration provided by the gas sensor 5 reaches a minimum value. The alarm module B is simultaneously driven by the main control module through the electric signal to sound an alarm with a beeping signal. The power control compartment 4 is provided with a charging seat 6 for charging the battery pack 43, wherein the charging seat 6 is connected to a power plug 61 engaged with an external power supply. A wire clip 12 is provided at the back part of the helmet 1, wherein the sheathed wire 3 is snapped into the wire clip 12. The wire clip 12 is located at 180 degrees from the snapping seat 11. The wire clip 12 is mainly used to accommodate the sheathed wire 3 in an easy way on the helmet 1. The control panel 44 is further provided with a power management circuit, and the main control module stores a power management program. The gas sensor 5 transmits the gas concentration value detected in the work area to the main control module, and the main control module computes the gas concentration signal value transmitted by the gas sensor and then compares the value with the reference value stored in the main control module. When the gas concentration is greater than 1%, the electric signal will drive the lamp holder assembly to raise an alarm by red blinking lights, and simultaneously drive the alarm module to sound an alarm with a beeping signal. Furthermore, both the flicker frequency of the red blinking lights and the frequency of the beeping signal increase with the increasing gas concentration, which can promptly remind every user of the head lamp to quickly evacuate from the current work area. The main control module is able to record the latest 100 alarm information and related data. The present invention makes each user of the head lamp as a gas concentration monitor, so that the gas concentration can be effectively monitored in real time.

In the embodiment, the lamp holder assembly 2 comprises a lamp housing, a transparent lamp cover 21 provided inside the lamp housing, a reflector 22, an LED light source 23 and a signal acquisition panel 24. The reflector 22 is provided inside the transparent lamp cover 21, and the LED light source 23 is provided behind the reflector 22. The LED light source 23 is connected to the signal acquisition panel 24 through a switch button K. The LED light source 23 comprises a high-power LED lamp for illumination and a red warning alarm light for raising an alarm by flashing the light. The switch button K is pressed to control the high-power LED lamp on or off. A button installing window K1 is provided on the upper part of the lamp housing, wherein the button installing window K1 is provided with a sealing washer M1 with an explosion-proof function and a button cover N. A detection window K2 for installing the gas sensor 5 is provided on the lower part of the lamp housing, the gas sensor 5 is hermetically provided inside the detection window K2 through a sealing ring M2 with an explosion-proof function. The signal acquisition panel 24 is provided with a signal acquisition circuit. When the gas sensor 5 transmits the detected density data of methane in the gas to the signal acquisition panel 24, and the signal acquisition circuit of the signal acquisition panel 24 converts and amplifies the signal transmitted from the gas sensor 5, and then transmits the signal to the main control module through the sheathed wire 3.

In the embodiment, the lamp housing is assembled by a lamp socket 25, an explosion-proof sheath 26 and a lamp cover 27 from rear to the front successively. The detection window K2 and the button installing window K1 are both formed on the explosion-proof sheath 26. The front side of the lamp cover 27 is provided with a transparent explosion-proof glass. The gas sensor 5 is connected to the signal acquisition panel 24 through an inner line, and the sheathed wire 3 hermetically goes though the lamp socket 25 and is connected to the signal acquisition panel 24 with a sealing effect of no liquid penetration.

In the embodiment, a rear end of the lamp socket 25 is provided with a light snapping element 7 to engage with a snapping seat 11, wherein the light snapping element 7 is attached to the rear end of the lamp socket 25 with a hinge around a rotation shaft 8. Both sides of the light snapping element 7 are respectively provided with a snapping groove 71, which is engaged with a snapping strip of the snapping seat 11. The lamp socket 25 and the upper cover 41 are respectively provided with a waterproof joint F through which the sheathed wire 3 hermetically goes with a sealing effect of no liquid penetration.

In the embodiment, the lamp holder assembly 2 is detachably mounted onto the helmet 1 through the light snapping element 7, and the lamp holder assembly 2 is capable of rotating up and down relative to the light snapping element 7 around the rotation shaft 8. A minimum angle range of the up and down rotation of the lamp holder assembly 2 is 45 degrees, while a maximum angle range of the up and down rotation of the lamp holder assembly 2 is 90 degrees.

An explosion-proof mat F1 is pressed and provided between the lamp socket 25 and the explosion-proof sheath 26. The detection window K2 extends obliquely frontward and downward from the bottom of the explosion-proof sheath 26.

The upper part of the back side of the lamp socket 25 is formed with a wiring window K3 extending obliquely backward and upward, and the waterproof joint F of the lamp socket 25 is provided on the wiring window K3. The sheathed wire 3 is connected to the waterproof joint F, hermetically goes through the wiring window 3 of the lamp socket 25 with a sealing effect of no liquid penetration, and is then connected to the signal acquisition panel 24.

The control panel 44 is longitudinally fixed inside the compartment, and the lower end of the control panel 44 is provided with metal charging pins 45. The bottom of the main power supply housing 42 of the compartment is formed with a concave surface, and the metal charging pins 45 slightly extend downward out of the concave surface. The charging seat 6 is provided with charging elastic pieces 62, elastically contacting with the metal charging pins 45, to charge the electrically connected battery pack 43. The charging elastic pieces 62 are connected to the power plug 61.

The top of the charging seat 6 is formed with a charging recess 6*b*, capable of being inserted by the lower part of the main power supply housing 42. The charging elastic pieces 62 are rectangular metal pieces made of copper. An end of the metal piece is fixed in an installing chamber 6*a* of the charging seat 6, while the other end of the metal piece is a free end. A contact portion of the metal piece with which the metal charging pin 45 elastically contacts, elastically projects into the charging recess 6*b* through the installing chamber 6*a*.

The upper cover 41 is formed with a connection window 4*a*, and the waterproof joint F on the upper cover 41 is provided in the connection window 4*a*. The sheathed wire 3 extends into the compartment through the connection window 4*a* and is then electrically connected to the control panel 44.

The lamp holder assembly 2 has a 4-stage dimming function in normal operation mode. Each time the high-power LED is turned on through the switch button K, the main control module will automatically switch the brightness of the high-power LED to the brightness used in the last operation mode. The battery pack 43 is a lithium battery, and the battery pack 43 is capable of continuously working for 20 hours when the battery capacity is 100%.

In the survival mode, the red warning light of the lamp holder assembly 2 flashes in SOS mode. The high-power LED for illumination will automatically switch to power saving mode, whereby the battery pack 43 is capable of continuously illuminating for 200 hours when the battery capacity is 100%. Further, the alarm sound can be manually switched on.

The foregoing is a further detailed description of the present invention, for those skilled in the art, various changes and modifications may be made without departing from the concept of the present invention. All such changes and modifications are intended to fall within the scope of the present invention.

What is claimed is:

1. A gas warning head lamp, comprising a helmet and a head lamp, configured to be worn separately, wherein the head lamp comprises a lamp holder assembly, a power control compartment and a sheathed wire, wherein a front face of the helmet is provided with a snapping seat, and the lamp holder assembly is snapped into the snapping seat on the helmet, wherein the power control compartment comprises an upper cover of the compartment, a main power supply housing, a battery pack and a control panel; wherein the upper cover and the main power supply housing are assembled together in a sealed explosion-proof configuration to form a housing of the power control compartment, wherein the battery pack and the control panel are provided inside the compartment and electrically connected to each other by a built-in line; wherein an end of the sheathed wire hermetically goes though the upper cover with a sealing effect of no liquid penetration and is electrically connected to the control panel, and an other end of the sheathed wire is hermetically connected to the lamp holder assembly by the waterproof liquid; a gas sensor for gas concentration detection in a current working area is integrated in the lamp holder assembly, wherein the control panel at least comprises a main control module for driving the lamp holder assembly to raise an alarm by a blinking light through an electric signal when the gas concentration provided by the gas sensor reaches a minimum value, and an alarm module is simultaneously driven by the main control panel through the electric signal to sound an alarm with a beeping signal;

wherein the power control compartment is provided with a charging seat for charging the battery pack, wherein the charging seat is connected to a power plug engaged with an external power supply, wherein a wire clip is provided at the back part of the helmet, the sheathed wire is snapped into the wire clip, and the wire clip is located at 180 degrees from the snapping seat.

2. The gas warning head lamp of claim 1, wherein the lamp holder assembly comprises a lamp housing, a transparent lamp cover provided inside the lamp housing, a reflector, an LED light source and a signal acquisition panel, wherein the reflector is provided inside the transparent lamp cover, and the LED light source is provided behind the reflector, wherein the LED light source is connected to the signal acquisition panel through a switch button, and a button installing window is provided on an upper part of the lamp housing, wherein the button installing window is provided with a sealing washer with an explosion-proof function and a button cover, a detection window for installing the gas sensor is provided on a lower part of the lamp housing, the gas sensor is hermetically provided inside the detection window through a sealing ring with the explosion-proof function.

3. The gas warning head lamp of claim 2, wherein the lamp housing comprises a lamp socket, an explosion-proof sheath and a lamp cover, and the lamp socket, the explosion-proof sheath and the lamp cover are assembled from rear to front successively, wherein the detection window and the button installing window are both formed on the explosion-proof sheath, a front side of the lamp cover is provided with transparent explosion-proof glass; the gas sensor is connected to the signal acquisition panel, and the sheathed wire hermetically goes though the lamp socket with a sealing effect of no liquid penetration and is connected to the signal acquisition panel.

4. The gas warning head lamp of claim 3, wherein a rear end of the lamp socket is provided with a light snapping element, and the light snapping element is engaged with a snapping seat, wherein the light snapping element is attached to the rear end of the lamp socket with a hinge around a rotation shaft, both sides of the light snapping element are respectively provided with a snapping groove, which is engaged with a snapping strip of the snapping seat, wherein the lamp holder and the upper cover are respectively provided with a waterproof joint through which the sheathed wire hermetically goes with a sealing effect of no liquid penetration.

5. The gas warning head lamp of claim 4, wherein the lamp holder assembly is detachably mounted onto the helmet through the light snapping element, and the lamp holder assembly is capable of rotating up and down relative to the light snapping element around the rotation shaft, wherein a minimum angle range of the up and down rotation of the lamp holder assembly is 45 degrees, while a maximum angle range of the up and down rotation of the lamp holder assembly is 90 degrees.

6. The gas warning head lamp of claim 5, wherein an explosion-proof mat is pressed and provided between the lamp holder and the explosion-proof sheath, the detection window extends obliquely frontward and downward from the bottom of the explosion-proof sheath.

7. The gas warning head lamp of claim 6, wherein the LED light source comprises a high-power LED for illumination and a red warning alarm light for raising an alarm by flashing the light; the upper part of a back side of the lamp holder is formed with a wiring window extending obliquely backward and upward, the waterproof joint of the lamp holder is provided on the wiring window, and the sheathed wire hermetically goes through the wiring window of the lamp socket by the waterproof liquid, and is connected to the signal acquisition panel.

8. The gas warning head lamp of claim 7, wherein the control panel is longitudinally fixed inside the compartment, and a lower end of the control panel is provided with a metal charging pin; a bottom of the main power supply housing of the compartment is formed with a concave surface, and the metal charging pin slightly extend downward out of the concave surface, wherein the charging seat is provided with a charging elastic piece, elastically contacting with the metal charging pin to charge the electrically connected battery pack, and the charging elastic piece is connected to the power plug.

9. The gas warning head lamp of claim 8, wherein the top of the charging seat is formed of a charging recess, wherein a lower part of the main power supply housing is configured to be inserted in the charging recess, wherein the charging elastic piece is a rectangular metal piece made of copper, an end of the metal piece is fixed in an installing chamber of the charging seat, and an other end of the metal piece is a free end, wherein a contact portion of the metal piece elastically projects into the charging recess through the installing chamber, and the contact portion of the metal piece elastically contacts with the metal charging pin.

10. The gas warning head lamp of claim 9, wherein the upper cover is formed with a connection window, the waterproof joint on the upper cover is provided in the connection window, and the sheathed wire extends into the compartment through the connection window and is electrically connected to the control panel.

* * * * *